US006367547B1

(12) United States Patent
Towers et al.

(10) Patent No.: US 6,367,547 B1
(45) Date of Patent: Apr. 9, 2002

(54) DOWNHOLE SEPARATOR FOR USE IN A SUBTERRANEAN WELL AND METHOD

(75) Inventors: Darrin N. Towers, Carrollton; Kenneth L. Schwendemann, Lewisville, both of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/293,425

(22) Filed: Apr. 16, 1999

(51) Int. Cl.[7] ..... E21B 43/12; E21B 43/14; E21B 43/58; E21B 34/08; B65G 5/00

(52) U.S. Cl. ..... 166/265; 166/54; 166/105.5; 405/55; 405/59

(58) Field of Search ..... 166/54, 54.1, 105.5, 166/265; 405/53, 55, 59; 175/263

(56) References Cited

U.S. PATENT DOCUMENTS

| | | | | |
|---|---|---|---|---|
| 1,249,232 A | | 12/1917 | Squires | |
| 2,198,573 A | | 4/1940 | Davis et al. | |
| 2,207,334 A | | 7/1940 | Reynolds et al. | |
| 2,523,091 A | | 9/1950 | Bruce | |
| 2,749,988 A | | 6/1956 | West | |
| 2,754,911 A | | 7/1956 | Spearow | |
| 2,767,792 A | | 10/1956 | Spearow | |
| 3,066,732 A | | 12/1962 | McEver | |
| 3,216,497 A | | 11/1965 | Howard et al. | |
| 3,371,711 A | | 3/1968 | Odeh et al. | |
| 3,989,108 A | | 11/1976 | Allen | |
| 4,016,930 A | | 4/1977 | Arnold | |
| 4,026,359 A | | 5/1977 | Closmann | |
| 4,241,787 A | | 12/1980 | Price | |
| 4,296,810 A | | 10/1981 | Price | |
| 4,429,581 A | | 2/1984 | Furmaga | |
| 4,458,524 A | | 7/1984 | Meador et al. | |
| 4,610,793 A | | 9/1986 | Miller | |
| 4,733,723 A | | 3/1988 | Callegari, Sr. | |
| 4,766,957 A | * | 8/1988 | McIntyre | 166/265 |
| 4,770,243 A | | 9/1988 | Fouillout et al. | |
| 4,793,408 A | | 12/1988 | Miffre | |

(List continued on next page.)

FOREIGN PATENT DOCUMENTS

EP 0 811 749 A1 12/1997

*Primary Examiner*—William Neuder
*Assistant Examiner*—Jennifer M Hawkins
(74) *Attorney, Agent, or Firm*—Paul I. Herman; James J. Murphy

(57) ABSTRACT

In accordance with the present invention, a downhole separation tool is provided which utilizes a downhole separation chamber with a series of fluid regulators responsive to a formation fluid and constituent components for separate desirable formation yields from the less desirable yields prior to lifting the fluids to the surface. The separation chamber has an input for the formation fluid, a production output, and a disposal output, in a tree arrangement according to the density order of the fluids in the separation chamber. The input flow regulator is coupled to the separation chamber input, the production regulator is coupled to the production output, and the disposal regulator is coupled to the disposal output. Each of the regulators are responsive to a fluid density of the formation fluid, first constituent and remainder constituent, accordingly, to regulate the flow of the respective fluid. According to a method of the present invention of separating a production fluid downhole, a production fluid is flowed from a subterranean formation into a separation chamber. The production fluid is separated over a given residence time period into a series of constituent layers. The first constituent, such as oil, is lifted in a generally continuously manner when under sufficient pressure to the surface, and the remainder constituent, such as salt water, is disposed to a disposal layer in the subterranean formation.

18 Claims, 4 Drawing Sheets

U.S. PATENT DOCUMENTS

| | | | | | |
|---|---|---|---|---|---|
| 4,805,697 | A | | 2/1989 | Fouillout et al. | |
| 4,900,433 | A | | 2/1990 | Dean et al. | |
| 4,969,524 | A | | 11/1990 | Whiteley | |
| 5,129,759 | A | * | 7/1992 | Bishop | 405/59 |
| 5,212,990 | A | | 5/1993 | Stout et al. | |
| 5,296,153 | A | | 3/1994 | Peachey et al. | |
| 5,310,282 | A | * | 5/1994 | Voskamp | 405/58 |
| 5,332,039 | A | | 7/1994 | Primeaux et al. | |
| 5,333,684 | A | * | 8/1994 | Walter et al. | 166/54 |
| 5,343,945 | A | | 9/1994 | Weingarten et al. | |
| 5,366,011 | A | | 11/1994 | Jennings, Jr. | |
| 5,377,756 | A | | 1/1995 | Northrop et al. | |
| 5,389,128 | A | | 2/1995 | Lopes | |
| 5,425,416 | A | | 6/1995 | Hammeke et al. | |
| 5,431,228 | A | | 7/1995 | Weingarten et al. | |
| 5,456,837 | A | | 10/1995 | Peachey | |
| 5,490,562 | A | | 2/1996 | Arnold | |
| 5,525,146 | A | | 6/1996 | Straub | |
| 5,549,159 | A | | 8/1996 | Shwe et al. | |
| 5,570,744 | A | | 11/1996 | Weingarten et al. | |
| 5,579,838 | A | | 12/1996 | Michael | |
| 5,588,486 | A | | 12/1996 | Heinrichs | |
| RE35,454 | E | | 2/1997 | Cobb | |
| 5,653,286 | A | | 8/1997 | McCoy et al. | |
| 5,662,167 | A | | 9/1997 | Patterson et al. | |
| 5,693,225 | A | | 12/1997 | Che-Keung Lee | |
| 5,697,448 | A | | 12/1997 | Johnson | |
| 5,857,519 | A | | 1/1999 | Bowlin et al. | |

* cited by examiner

FIG. 1
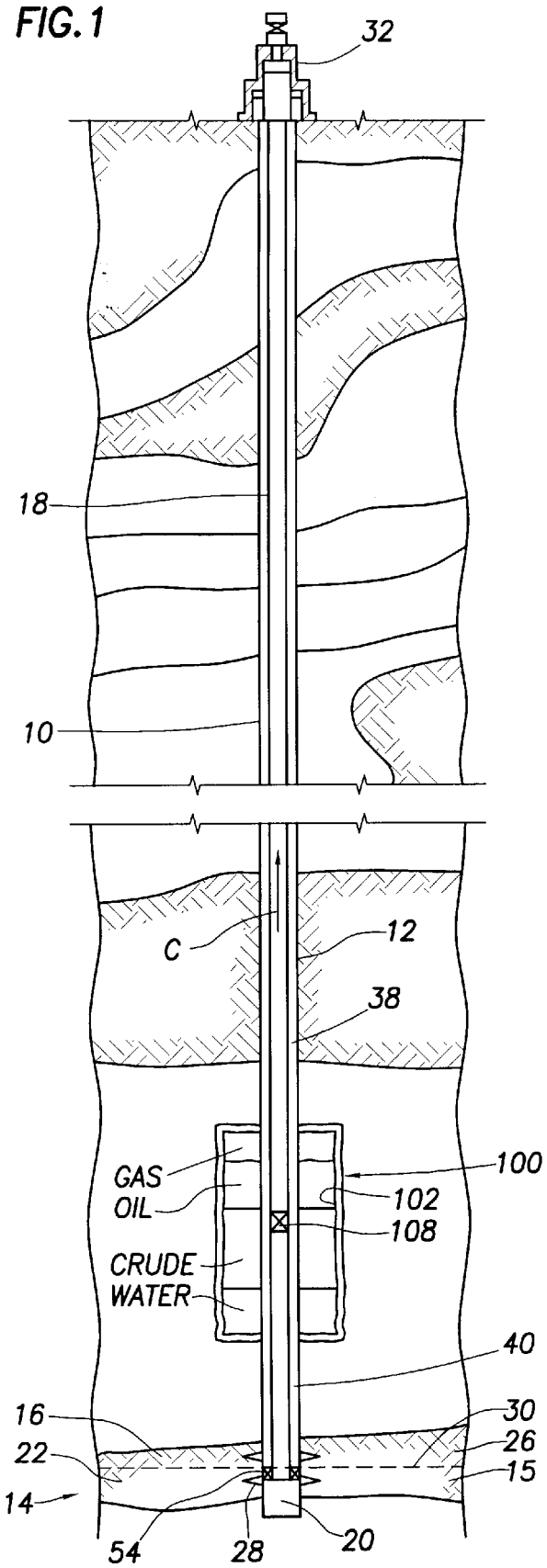
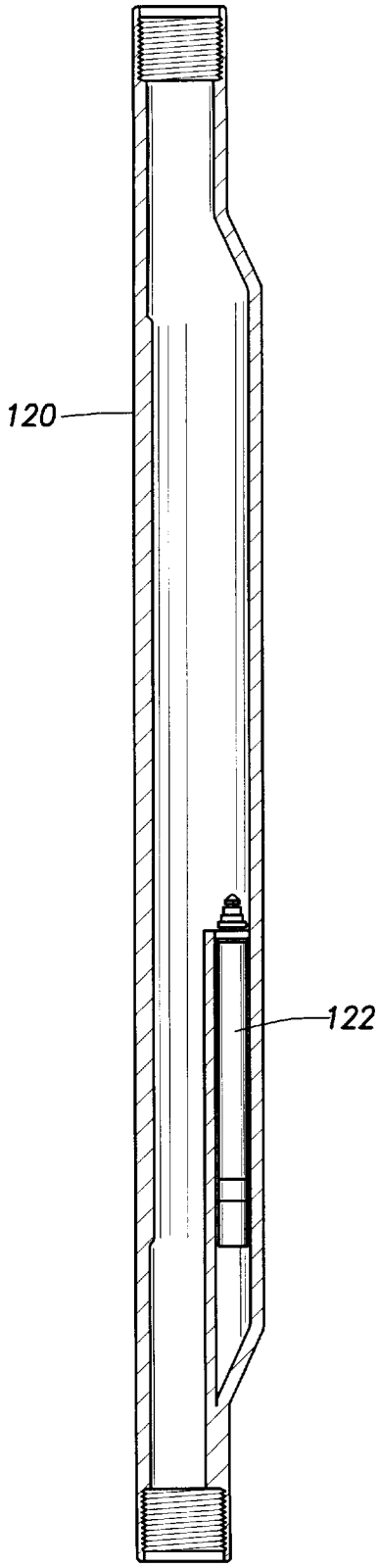
FIG. 3

DOWNHOLE SEPARATOR FOR USE IN A SUBTERRANEAN WELL AND METHOD

TECHNICAL FIELD

This invention relates generally to a downhole apparatus utilized to substantially separate, while downhole, a formation fluid from a subterranean well into constituent portions, and in particular to a downhole separation apparatus for producing and then conveying petroleum products to the well surface separately from undesirable products that are returned to a formation.

BACKGROUND OF THE INVENTION

Oil and/or gas wells quite often pass through a productive strata whose yield, besides including oil, gas and other valuable products also includes undesirable and unwanted denser constituents such as salt water. In oil well production operations, relatively large quantities of water are frequently produced along with the valuable petroleum products. This is particularly true during the latter stages of the producing life of a well. Handling this water at the surface represents a significant expense in lifting, separation, and disposal.

Various methods have been employed for extracting the valuable petroleum yield from the denser and unwanted constituents. Some have involved the pumping of the total yield to the surface of the well and then using various methods for separating the valuable yield from the unwanted portion of the yield. In addition, the unwanted portion of the yield, after having been pumped to the well surface and separated, has been then pumped downwardly again through a remote well bore into a disposal layer.

In some oil wells, the unwanted denser constituents can amount to as much as 80% to 90% of the total formation yield. Accordingly, to obtain a given volume of valuable petroleum yield from the well, eight or nine times the volume of the valuable yield must first be pumped to the surface of the well and then separated from the unwanted portion of the formation yield. As set forth above, this process can be very slow and expensive. Although the problem of producing substantially water-free oil from a reservoir may occur at any stage in the life of an oil well, the proportion of water to valuable yield generally increases with time as the oil reserves decline. Ultimately, when the lifting costs of the combined petroleum and water constituents exceed the value of the recovered oil, abandonment of the well becomes the only reasonable alternative.

Many procedures have been tried for producing water-free oil from a formation that has a large quantity of water. For example, the oil and water produced are pumped or otherwise flowed together to the surface where they are then treated to separate the petroleum from the water. Since the volume of the water is usually much greater than that of the oil, the separator must handle large volumes of fluid and therefore is large and accordingly expensive. Moreover, the water produced contains mineral salts which are extremely corrosive, particularly in the presence of air. Also, flowing the oil and water together upwardly through the well sometimes forms emulsions that are difficult to break. Such emulsions frequently must be heated in order to separate them even when in the presence of emulsion treating chemicals. The heating of the large amount of water, as well as the small amount of oil, requires an expenditure of large amounts of energy, reducing the net equivalent energy production from the well Water produced from deep formations within the earth frequently contains large amounts of natural salts. For this reason, the salt water brought to the surface cannot be disposed of by allowing it to flow into surface drains or waterways. Relatively small volumes of salt water can sometimes be disposed of by drainage into a slush pit or evaporation tank. The required disposal method for large volumes of salt water, however, is to introduce the water into a subsurface formation. This requires a disposal well for receiving the produced salt water.

By returning the water to the same formation in this manner, the water is disposed of and also acts more or less as a re-pressurizing medium or drive to aid in maintaining the bottom hole pressure and driving the well fluids toward the producing well. But, in those areas where producing wells are widely separated, the cost of drilling disposal wells for each producing well is prohibitive. In such instances it is necessary to lay a costly pipeline-gathering network to bring all of the produced water to a central location, or alternatively, to transport the produced water by trucks or similar vehicles. Regardless of the method for transporting the waste salt water from a producing well to a disposal well, the cost of the disposal can be, and usually is, prohibitive.

Furthermore, fluids from subterranean reservoirs can have undesirable characteristics such as excessive pressure and being super-heated. If excessive pressure is present, then surface equipment, such as a choke manifold, must be installed to choke the flow pressure down to about 2,000 p.s.i. If a highly pressurized fluid depressurizes within a short amount of time, then a large portion of the gas is "flashed" in that a chemical reaction occurs. This reaction adversely affects the desirable petroleum yield from the formation yield. In general, both well seals and surface equipment suffer in the presence of excessive fluid pressure and heat. This equipment is expensive in terms of maintenance and capital costs. Thus, it is highly desirable to minimize these undesirable characteristics of the well flow before being brought to the surface.

Downhole separation has been utilized to a limited extent through the use of hydrocyclones, or combinations of mechanical pumps and gravity separation for achieving separation of production fluids into water and hydrocarbon components. An example of such a device is provided in U.S. Pat. No. 5,857,519, issued Jan. 12, 1999 to Bowlin et al., which recites a method and apparatus for the downhole disposal of a water component of a production fluid while using gas lift techniques to lift the hydrocarbon component. Separation of the water component from the production fluid occurs in the annulus between the well casing string and the well tubing string. The gas lifting technique uses gas lift valves spaced along the length of the casing string for high-pressure injection of gas into the tubing string to lift the hydrocarbon component. Disposal of the water fluids into an underlying formation is provided by a pump mechanism.

But previous devices have been limited to secondary recovery methods in which the natural pressure of a formation is waning. Secondary recovery methods, such as gas lift, or pump jacks, have additional energy requirements for bringing a production yield to the surface. Accordingly, the capacity for these devices to accommodate high production fluid flows is limited, and furthermore, generally requires additional hardware and equipment placed within the bore, restricting the effective inner diameter of a tubing string. A restricted inner diameter affects the ability for routine maintenance of a well below the separation device, as well as upkeep and maintenance of the pumps and hydrocyclones.

Accordingly, a need exists for a downhole separator that separates the valuable yield from a production yield, and that can leave the unwanted portion of the yield downhole. Also needed is a downhole device that can moderate high-pressure and high-temperature characteristics of the production yield. Additionally, a downhole separator is needed for allowing separation of production fluids into constituent portions from the primary recovery lifespan through the secondary and tertiary recovery lifespans of a well.

SUMMARY OF THE INVENTION

Provided is a downhole separator that separates the valuable yield from a production yield that can leave the unwanted portion of the yield downhole. The downhole separator of the present invention can also moderate high-pressure and high-temperature characteristics common to primary production flows, as well as provide downhole separation for secondary and tertiary recovery phases of a well lifespan.

An aspect of the present invention is a method for separating a valuable yield from a production fluid. The method provides under-reaming a portion of a well bore such that a separation chamber is defined in a downhole environment, receiving the production fluid in the separation chamber, and quiescently separating the valuable yield from the production fluid in the separation chamber. The valuable yield can then be conveyed from the separation chamber.

Another aspect of the present invention is a downhole separation chamber. The downhole separation chamber has an under-reamed cavity that is defined in the downhole environment about a portion of a well bore. The under-reamed cavity has an interior volume sufficient to quiescently separate a valuable yield from the production fluid, which can be received in the under-reamed cavity.

In a further aspect of the present invention, a downhole separation tool is provided which utilizes a downhole separation chamber with a series of fluid regulators responsive to, a formation fluid and constituent components to separate desirable formation yields from the less desirable yields prior to lifting the fluids to the surface. The separation chamber has an input for the formation fluid, a production output, and a disposal output, in a tree arrangement according to the density order of the fluids in the separation chamber. The input flow regulator is coupled to the separation chamber input, the production regulator is coupled to the production output, and the disposal regulator is coupled to the disposal output. Each of the regulators are responsive to a fluid density of the formation fluid, first constituent and remainder constituent, accordingly, to regulate the flow of the respective fluid.

According to another aspect of the present invention, a method of separating a production fluid downhole is provided where a production fluid is flowed from a subterranean formation into a separation chamber. The production fluid is separated over a given residence time period into a series of constituent layers. The first constituent, such as oil, is lifted in a generally continuous manner when under sufficient pressure to the surface, and the remainder constituent, such as salt water, is disposed to a disposal layer in the subterranean formation.

In yet another aspect of the present invention, if there is insufficient pressure to lift the first constituent toward the surface, a second constituent, such as gas, can be injected into the first constituent to provide a sufficient lifting capacity for the first constituent. In yet a further aspect, the first constituent is injected under pressure into the separation chamber to urge the remainder constituent into the disposal layer.

BRIEF DESCRIPTION OF THE DRAWINGS

The accompanying drawings are incorporated into and form a part of the specification to illustrate examples of the present invention. This drawing together with the description serve to explain the principles of the inventions. The drawings are only included for purposes of illustrating preferred and alternative examples of how the inventions can be made and used and are not to be construed as limiting the inventions to only the illustrated and described examples. Various advantages and features of the present inventions will be apparent from a consideration of the drawings in which:

FIG. 1 is a schematic illustration of a side-wall separator of the present invention in a downhole environment;

FIG. 3 is an illustration of a side-pocket mandrel that can be used to implement components of the side-wall separator of the present invention;

DETAILED DESCRIPTION

Figure 2:
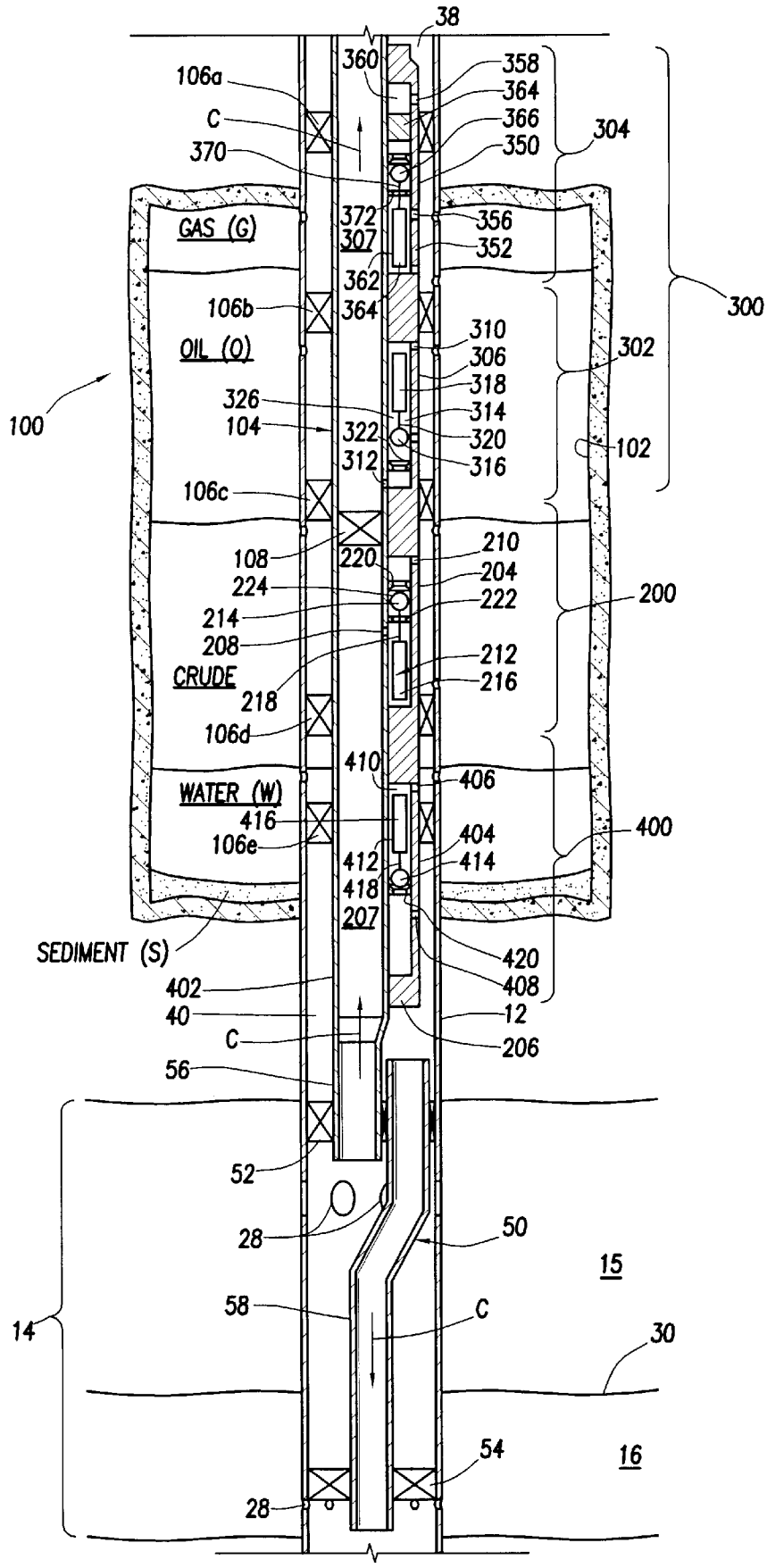
FIG. 2 is a cross-sectional view of the side-wall separator assembly in the downhole environment in an operational mode.

The principles of the present invention and their advantages are best understood by referring to the illustrated embodiment depicted in the FIGURES, in which like reference numbers describe like parts. In these figures and the accompanying description arrow "C" is used to indicate the upward or uphole direction. The reverse of arrows "C" refers to the downward or downhole direction. The upward and downward directions used herein are for reference purposes only, and it is appreciated that not all wells extend vertically, and that the present invention has utility in non-vertical well configurations.

FIG. 1 illustrates a side-wall separator, generally designated by the numeral 100, in a downhole environment. The downhole environment has multiple earth formations traversed by a well bore 10, which is drilled using conventional techniques. Defined in the well bore 10 is an enlarged well bore portion that defines a separation chamber 102.

The well bore 10 is fitted with a production casing 12. The production casing 12 is received through the separation chamber 102. A production string 18 extends through the production casing 12 to a lower interior zone 20, which as illustrated, is adjacent a petroleum formation 14. The petroleum formation 14 is generally illustrated as having a production layer 15 and a disposal layer 16. These layers are defined by the characteristic that oil is light than water, so that oil in a formation is pushed toward the top, forming a production layer, and water and other residual products are pushed downward by the weight of the oil, defining a disposal layer.

A production zone 22 is defined at the interior zone 20 with isolation packers 54 deployed along the well bore 10 adjacent the petroleum formation 14. A disposal zone 26 is preferably defined adjacent the disposal layer 16 of the petroleum formation 14. The locations of the production zone 22 and the disposal zone 26 are determined by any of the known methods of well logging. It should be noted that a disposal zone may be located within other suitable downhole formations substrates capable of providing a disposaltype function. Perforations 28 are formed in the casing by conventional perforation techniques. The perforations 28 in the production zone 22 permit production fluids to enter the interior of the casing 12. The perforations 28 in the disposal zone 26 permit water (and other fluids relatively dense compared to oil and gas fluids in that there is a greater concentration of fluid components in a given volume) separated from the production fluid according to the teachings of the present invention to be discharged into the disposal zone 26.

The term "fluid" as used herein means a material capable of flowing, and may include gases, liquids, plastics, and solids that can be handled in the manner of a liquid. Production fluid has a valuable petroleum yield, and an unwanted portion of the yield. The production fluid can also be referred to as crude, which, as used herein means crude petroleum oil and all other hydrocarbons available from the petroleum formation 14.

Prior to the drilling of the well bore 10 into the petroleum formation 14, there is a more or less defined normal fluid, or static, interface 30 between the production layer 15 and the disposal layer 16 of the porous petroleum formation 14. This layer is also referred to as an oil/water interface. The fluids have been segregated in the petroleum formation 14 by gravity into their respective production and disposal zones due to their different specific gravities.

The perforations 28 are preferably made in the casing slightly above the oil/water interface 30. Continued production of the crude fluid from a well gradually reduces the thickness of the production or crude layer and permits the static interface 30 to rise to its maximum level.

In completing the well according to the present invention, the production string 18 extends from a surface well head 32 to a conventional production packer, which defines an annulus between the production casing 12 and the production string 18. Another production packer also anchors the production string 18 in the well bore 10.

According to the invention in its broadest aspects, formation fluid from the production layer 15—including constituents such as oil, water, and gas—enters the production casing 12 through the perforations 28 and is conveyed under formation or surface pump pressure to a side-wall separator assembly 100, discussed later in detail.

In general, crude recovery at the surface can be made through primary, secondary, and tertiary recovery methods. Under primary recovery, crude is urged through the perforations 28 by pumping or by natural drive mechanisms such as a depletion drive or a water drive. Depletion drives are common to a closed formation, wherein the oil does not come in contact with water-bearing permeable sands. Since the formation fluid is in effect isolated in an enclosed space, the energy available to drive it to the surface is from the gas in solution with the oil, forming a solution-gas drive, or, from the gas above the oil in the accumulation, forming a gas-cap drive. A water drive occurs when water moves in to occupy the space left as the formation fluid is removed, and the pressure of the water urges the formation fluid toward the surface.

Secondary recovery is the next attempt at production after the crude that is economically feasible has been recovered under primary recovery principles. Tertiary recovery is the third attempt at production after all the crude has been obtained that is possible by primary and secondary recovery methods.

The side-wall separator assembly 100 and the separation chamber 102 of the present invention provides downhole separation from primary through tertiary recover methods. As shown, the separator assembly 100 operates in relation to the side-wall region of the well bore 10. The separation chamber 102 can be defined from the diameter of the well bore to an enlarged diameter that provides a volume to accommodate sufficient separation of constituents in a production flow.

Flow valves, discussed later in detail, are coupled to the production string 18 to allow production fluids to flow from the formation 14 through the production string 18. The term "coupled" as used herein means something that joins or links two things together, or to bring into such close proximity as to permit mutual influence.

After the production fluid is separated into its gas phase, oil phase, and water phase by the separator assembly 100, the oil phase of the formation fluid is flowed through the production string 18 to the well head 32 where it is stored in a holding tank (not shown) for transport to a refinery. The gas phase of the formation fluid is flowed through the upper annulus 38 (relative to the chamber 102) between the production casing 12 and the production string 18 to the well head 32 where it is stored for transport to a refinery. If the amount or value of the gas is minimal, the gas can be transported to a site where it can be safely disposed by flaring. The separated water, on the other hand, is discharged through the lower annulus 40 (relative to the chamber 102) into the disposal zone 26.

According to this arrangement, oil is produced and delivered at the well head 32, and disposal fluids are discharged into the disposal zone 26. With the present invention, downhole separation may take place under high-pressure and high flow input conditions because the separator assembly 100 and the separation chamber serve to regulate and conserve formation pressure energy. That is, the difference in pressure between the production zone 22 and the separation chamber 102 is minimized by the separator assembly 100, allowing discharge of disposal fluids into the disposal zone 26 under pressure provided by a gravitational effect on the disposal fluids.

FIG. 2 shows the side-wall separator assembly 100 in a downhole environment that defines the separation chamber 102. Coupled to the production string 18 is a fluid separator 104. The fluid separator 104 receives the production flow from the petroleum formation 14. The production flow is a fluid, and has typically at least a first and a second constituent, such as oil and water.

As described in further detail below, a production fluid can be separated into its constituent parts in a separation chamber defined in the downhole environment by under-reaming a portion of a well bore, receiving the production fluid in the chamber 102, quiescently separating the valuable yield from the production fluid, and conveying the valuable yield from the separation chamber 102.

It should be noted that the term "valuable yield" as used indicates the constituents that are sought to be brought to the surface, such as the oil and gas constituents that typically have lower densities with respect to other constituents of the production fluid; however, the valuable yield of the production fluid is not dictated by the subsequent end use, disposal, or refinement at the surface. For example, the gas constituent may be "flared" at the surface as a by-product, but is still considered a part of the valuable yield of the production fluid.

The separation chamber 102 has a generally cylindrical shape formed by large bore drilling to widen or enlarge the well bore. In other words, an under-reamed portion of the well bore provides the separation chamber 102 in the downhole environment. The separation chamber 102 is in fluid communication with a formation for receiving the production fluid having a valuable yield. The separation chamber 102 has an interior volume sufficient to quiescently separate the valuable yield from the production fluid, as is discussed in detail below. If the surrounding formation is excessively porous such that the effectiveness of the separator is adversely affected, the separation chamber 102 can be sealed. Sealing materials, such as quickset, are known to those skilled in the art.

The permeability of the separation chamber can be determined through conventional techniques based on the viscosity of fluids in the surrounding chamber formation, the size and shape of the surrounding chamber formation, and the pressure and the flow of the fluid, if any, from the surrounding chamber formation. A naturally occurring impermeable formation layer is preferred to avoid additional separator chamber preparation and associated costs. With respect to high flow conditions present in primary recovery operations (which may range from 1,000 barrels per day to 30,000 barrels or more per day depending on the well characteristics), the separation chamber 102 provides a diffuser effect on a production flow conveyed through the production string 14.

A "diffuser" is understood as a form of energy conversion of a flowing fluid in which fluid kinetic energy is converted into enthalpy, which is the sum of the internal energy of a body and the product of its volume multiplied by the pressure. The control volume of the present invention is provided by the separation chamber 102. Enthalpy, H, is defined by:

$$H=U+PV$$

Where:

U is the internal energy, which is a measure of energy stored in, or possessed by, the system due to the microscopic kinetic and potential energy of the molecules of the substance in the system, or closed volume;

P is the pressure within the separation chamber 102; and

V is the volume of the separation chamber 102.

The effect of the diffusion, with respect to the production fluid conveyed by the production string 14, is to decrease the velocity of the production flow while the pressure increases within the chamber.

The side-wall separator assembly 100 is a gravity separation device. Gravity separation allows the crude collected within the separation chamber 102 to separate under 1-g of force into stratified layers organized with respect to the constituent densities (also referred to in terms of specific gravity).

The specific gravity of a substance is the ratio of the density of the substance to the density of some substance taken as a standard when both densities are obtained by weighing the substance in air. (For example, if one cubic inch of oil weighs in air 0.84 times as much as one cubic inch of water, then the specific gravity of the oil is 0.84).

The separation chamber 102 has a volume dimension to generate a desired residence-time for separating a production fluid into its constituents. As used herein, the term "residence-time" is the time a particle resides in the separation chamber 102. The greater the residence-time, the greater the degree of separation of the constituents. In general, a larger separation chamber can be fabricated and used downhole than would be practical for surface construction, thus realizing a cost savings compared with conventional surface separators. In this manner, a quiescent separation is conducted downhole while the production fluid in the chamber 102 is in a state of substantial repose or rest.

It is understood that the constituents referred to are defined as a function of the density characteristics of a constituent. In turn, the valve mechanisms of the fluid separator 104 are responsive to these density characteristics, as discussed below in detail. Thus, the references to "gas," "oil," "water," and "crude" are for convenience purposes to designate constituents having dissimilar density characteristics. Also, it should be noted that the separation characteristics of the separator 104 are concentrated on the valuable petroleum yield and that separation of all possible constituents of the undesirable yield is not necessary to carry out the spirit and scope of the present invention.

A further aspect of the present invention is that the natural occurring heat of the surrounding formation contributes to the effectiveness of separating the crude in the separation chamber 102. Higher temperatures result in higher overall crude viscosity, allowing more ready and thorough separation of the crude constituents. For example, a conventional separation at the surface would heat the crude with a steam heater to about 250–360° F. (about 121–182° C.). For comparison, downhole temperatures of about 300° F. (about 149° C.) can be realized.

A further advantage of the present invention is that the separation chamber 102 provides a heat sink for high temperature crude, which is about 350° F. to about 450° F. (from about 177° C. to about 232° C.). That is, a heat sink effect is provided due to the comparatively lower temperature of the surrounding formation, drawing heat energy from the fluid as it separates. This moderation effect removes the requirement for high-temperature fluid surface facilities, realizing additional savings in cost and space.

The fluid separator 104 is aligned with the separation chamber 102 through the production string 18, and is positioned and sealed with packers 106*a*, 106*b*, 106*c*, 106*d*, and 106*e*.

As shown in FIG. 2, the fluid separator 104 has an input unit 200 coupled to a fluid production unit 300 for conveying production fluids to a surface of the well. A fluid disposal unit 400 is coupled to the input unit 200 for conveying denser constituents fluids to a disposal zone below the separation chamber 102.

The input unit 200 is in fluid communication with the chamber 102. The input unit 200 has an input valve assembly 204 that is responsive to a density property of the production flow from the petroleum formation 14 in a form generally referred to as crude. The input valve assembly 204 is coupled to a body portion 206 defining a flow passage 207 therethrough. The valve assembly 204 selectively obstructs the movement of crude from the flow passage 207 defined in the body portion 206 to the chamber 102 with respect to a level of the crude within the chamber 102.

The input valve assembly 204 is coupled to the flow passage 207 of the body portion 206 through an input port 208 for the production fluids from the formation, and an output port 210. In the path between the input port 208 and the output port 210 is a float valve 212 for controlling the flow of production fluids into the chamber 102.

The float valve 212 has a closure member 214 coupled to a float member 216 through a stem 218. The float member 216 can be biased with a spring member to remain disengaged from a first seat 220 and a second seat 222 to allow the crude to flow through the space 224 between the input port 208 and the output port 210. The amount of bias is less than the pressure exerted by the float member 216 when moved with respect to the level of the crude within the chamber 102. Because the float member 216 is responsive to a density property of the production flow, or crude, the closure member 214 is displaced relative to the level of the crude. With sufficient displacement, the closure member 214 engages either of the seats 220 or 222, substantially ceasing flow of the production fluid into the chamber 102. Also, the seating prevents the backflush of fluids into the flow passage 207 of the body portion 206.

The fluid production unit 300 is in communication with the separation chamber 102. The fluid production unit 300 can have multiple separator units to accommodate a fluid with multiple constituents with varying densities. For example, the formation fluid can have gas products that are lower in density than the oil product, such that at least two separator units are deployed to separate these products in the downhole environment.

With respect to FIG. 2, the fluid separator 104 is shown configured for a formation having a substantial volume of oil and gas constituents, in which the fluid production unit 300 has an oil separation unit 302 and a gas separation unit 304. The oil separation unit 302 is responsive to a density property of the oil to be brought to the surface, and the gas separation unit 304 is responsive to a density property of the gas to be brought to the surface. It should be noted that the fluid separator 104 can be configured for the particular formation with fluids having varying constituent characteristics.

The oil separation unit 302 is coupled to the input unit 200. The oil separation unit 302 has a body portion 306 defining a flow passage 307 therethrough. A valve assembly 308 is coupled to the body portion 306 such that fluid from the chamber separation chamber 102 can selectively flow into the flow passage 307 with respect to the level of oil within the separation chamber 102.

The valve assembly 308 is coupled to the flow passage 307 of the body portion 306 through an input port 310 and an output port 312. In a space 326 between the input port 310 and the output port 312 is a float valve 314 for controlling the flow of oil from the separation chamber 102.

As shown, the flow passage 207 and the flow passage 307 are separated from one another by a plug 108. The plug 108 is a conventional plug that is set within the interior passage of the side-wall separator assembly 100 to define separate flow passages 207 and 307. Also, the plug 108 may be removable to allow access to the portions below for well maintenance.

As discussed above, production flow from the petroleum formation 14 is had through the flow passage 207. As discussed below in detail, an oil flow to the surface is had through the flow passage 307. The float valve 314 has a closure member 316 coupled to a float member 318 through a stem 320. The float member 318 can be biased with a spring member to remain disengaged from a valve seat 322 to allow the oil to flow through the space 326 to regulate the production flow from the input port 310 into the flow passage 207. The amount of bias provided by the spring member is less than the pressure exerted by the float member 318 when moved with respect to the level of the oil within the separation chamber 102. Because the float member 318 is responsive to a density property of the separated oil, the closure member 316 is displaced relative to the level of the oil. With sufficient displacement, the closure member 316 engages the valve seat 322, substantially ceasing flow of the production fluid into the flow passage 207.

The gas separation unit 304 is threadingly coupled to the oil separation unit 302. The gas separation unit 304 has a body portion 350 defining a flow passage that extends the flow passage 307 therethrough for coupling with the flow passage of the production string 18 (see FIG. 1). A valve assembly 352 is coupled to the body portion 350 such that a fluid with a low density can selectively flow from the separation chamber 102 into the upper annulus 38 with respect to the level of gas within the separation chamber 102. The flow path is from an input port 356 to an output port 358. In a space 360 defined between the input port 356 and the output port 358 is a float valve 362 coupled to a check valve 364 for controlling the flow of gaseous fluids from the separation chamber 102 into the upper annulus 38.

The float valve 362 has a closure member 366 coupled to a float member 368 through a stem 370. The float member 368 can be biased with a spring member to remain off of a valve seat 372 to allow the low-density fluid to flow through the space 360 to regulate the production flow from the input port 356 into the upper annulus 38. The amount of bias is less than the pressure exerted by the float member 368 when moved with respect to the level of the low-density fluid within the separation chamber 102. Because the float member 368 is responsive to a density property of the separated or free gas, which is a low-density constituent, the closure member 366 is displaced relative to the level of the low-density constituent. With sufficient displacement, the closure member 366 engages the valve seat 372, substantially ceasing flow of the production fluid into the upper annulus 38.

An advantage of the present invention is its usefulness in high-production flows, as well as in secondary and tertiary recovery methods. Conventional downhole separators had been relegated to secondary and tertiary recovery methods due to the relatively sensitive nature of the mechanisms that had been used, such as pumps and hydrocyclones. These mechanisms also obstruct the effective inner diameter of a production string, correspondingly restricting the maximum level of flow, in feet-per-second ("fps") through a tubing string. Furthermore, conventional downhole separators could not endure the high pressure environments associated with a primary, or high-production, flow.

In contrast, the downhole separator 100 of the present invention can be used in high-production flow wells because of the capability to suppress flashing of gas constituents while also maintaining and regulating the production fluid flow passing through a production tubing with a diffuser effect provided by the transition from a the tubing string 14 to the separation chamber 102. The separation chamber 102 further provides an expansion zone in which energy from a production flow is removed sufficient to allow separation within the separation chamber 102, while allowing natural lift capacity for conveying the separated, desirable constituents of a production flow to the surface.

Pressure within the separation chamber 102 is further maintained and regulated by a check valve 364. The check valve 364 conserves a pressure level within the separation chamber 102 sufficient to suppress the flashing characteristic of the gas in the transfer between the separation chamber 102 and the upper annulus 38. Thus, pressure is conserved within the separation chamber 102 sufficient to allow the oil to be conveyed to the surface through the flow passage 307 under the pressure naturally provided by the formation 14.

Furthermore, if the formation flow is a high-pressure flow, then the check valve can be selected to also provide a low-magnitude pressure differential—sufficient to suppress flashing—between the transition between the separation chamber 102 and the upper annulus 38. A high-pressure flow, in reference to flashing, is dependent on the composition of the crude, which can be determined using conventional sampling methods.

The capability of the present invention to minimize flashing allows use in high-pressure productions wells, which are associated with high volume production wells. Further, the present invention may also be used in secondary recovery environments, as discussed below in detail. In this manner, the present invention has a useful lifespan extending from the primary production flow of a well through the secondary recovery phase.

The fluid disposal unit 400 is threadingly coupled to the input unit 200. The disposal unit 400 has a body portion 402 defining a flow passage 207 therethrough for coupling with the flow passage 207 extending below the separation chamber 102 (see FIG. 1). A valve assembly 404 is coupled to the body portion 402 such that a fluid with a density higher than the desirable constituents (crude, oil, and gas) can be selectively flowed from the separation chamber 102 into the lower annulus 40. The disposal flow path is from an input port 406 to an output port 408. In a space 410 defined between the input port 406 and the output port 408 is a float valve 412 for regulating the flow of disposal fluids from the separation chamber 102 into the lower annulus 40, which is then conveyed into the disposal zone 26.

The float valve 412 has a closure member 414 coupled to a float member 416 through a stem 418. The float member 416 can be biased with a spring member to disengage a valve seat 420 to allow the disposal fluid to flow through the space 410 between the input port 406 and the output port 408. The amount of spring bias is less than the pressure exerted by the float member 416 when moved with respect to the level of the disposal fluid such as water within the separation chamber 102. Because the float member 416 is responsive to a density property of the disposal fluid the closure member 414 is displaced relative to the level of the disposal fluid. With sufficient displacement, the closure member 414 engages the seat 420, substantially ceasing flow of the disposal fluid into the lower annulus 40.

Because disposal fluid constituents such as sediments, sand, gravel, or the like, are substantially denser than the surrounding disposal fluid constituents, they resist the tendency to being flowed to the disposal zone 16, and tend to remain in the separation chamber 102. The separation chamber 102 is of a size sufficient to serve as a repository of these accumulating sediments while still disposing of the less dense disposal fluids.

It should be noted that the amount of the substantially denser disposal fluids can also be moderated through the residence time of the separation chamber 102. That is, the residence time can be selected such that the valuable yield of the production fluid is substantially separated from the crude while a substantial amount of the denser disposal fluids remain suspended in the surrounding disposal fluids. In this manner, the denser disposal fluids can be carried to the disposal layer 16 with the surrounding, less dense, disposal fluids.

An advantage of having a separation chamber defined downhole is with respect to sediment accumulation. When the amount of sediment begins to interfere with the fluid separation capability of the side-wall separator, the present invention has the capability of relocating the fluid separator 104 to another downhole separation chamber.

As shown in FIG. 2, the disposal layer 16 of the formation 14 is below the production layer 15. This organization where the crude is on top of the water layer is common in unconsolidated sandstone aquifers, where the objective is to withdraw the crude while leaving as much of the disposal layer as undisturbed as possible. To access the disposal layer 16 for fluid injection, a conventional diverter assembly 50 can be used to bypass the production layer 15.

The diverter assembly has a dual packer 52 and an isolation packer 54. The dual packer 52 has a collar 56 extending therethrough and coupled to the body portion 402 of the fluid disposal unit 400. The collar 56 places the flow passage 207 in communication with the fluids of the production layer 15 through perforations 28 defined in the production casing 12.

Isolation packer 54 is deployed adjacent the perforations 28 such that production fluids within the production casing 12 are substantially isolated from fluids from the disposal layer 16. Extending through the dual packer 52 and the isolation packer 54 is a second collar 58. The second collar 58 places the lower annulus 40 in fluid communication with the disposal layer 16 so that the side-wall separator assembly can inject denser, less-desirable, fluids into the disposal layer 16.

FIG. 3 shows a side pocket mandrel 120 used to implement the input unit 200, the fluid production unit 300, and the fluid disposal unit 400. A side pocket mandrel 120 is preferably used due to its capability of selectively retrieving the valve assembly 122 through conventional wireline tools. That is, referring back briefly to FIG. 2, the separation chamber 102 can be formed in the well.

The production casing 12 is put into place and the series of perforations 28 are made using conventional perforation techniques. The separator assembly 100 can be deployed within the casing 12. As can be readily appreciated by those skilled in the art, the valve assembly structures described in detail above for valve assemblies 204, 308, 352, and 404 can be implemented in the valve assembly 122. The valve assembly 122 can travel down to the deployment site with the side pocket mandrel 120, or be installed at a later time.

Accordingly, the present invention allows simplified installation by providing preformed separation chambers 102 along a wellbore of the well. The separation chambers 102 are isolated by a casing string 12 or by a production string 18. Access to a separation chamber 102 can be subsequently provided using perforation techniques known to those skilled in the art.

Furthermore, the valve assembly 122 can be retrieved for modification or replacement in the event the valve assembly 122 stops functioning or the density properties of the production flow change. When the properties change substantially, the float member of the valve assembly can be replaced to conform to the properties of the individual density characteristics of the production flow constituents. It should be noted that float members are available with varying sensitivities or tolerances. Accordingly, the float members may be selected with a sensitivity or tolerance in accordance with the constituent characteristics of a well fluid sufficient to minimize frequent replacements of the float components.

Figure 4:
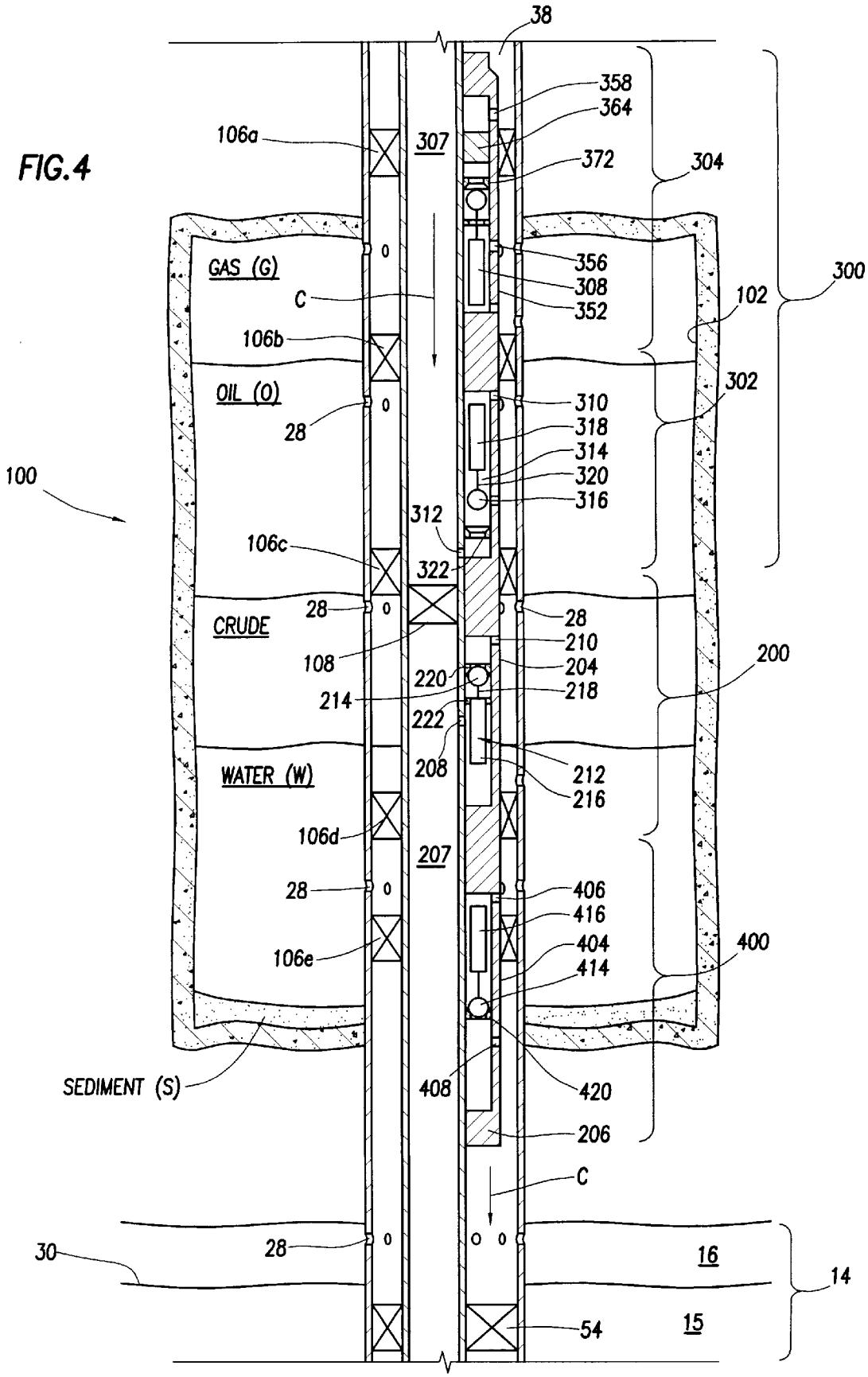
FIG. 4 is a cross-sectional view of the side-wall separator of the present invention in a high-water level operational mode.

FIG. 4 illustrates the operation of the side-wall separator assembly 100 where there is a high water level condition in the separation chamber 102. With high water conditions, the level of the water rises upward in the separation chamber 102.

A high water condition can occur under the several conditions. For example, in high-pressure formations, water and other dense constituents separated in the separation chamber 102 are not returned by gravitational forces alone. That is, a loss of pressure is typically realized between the formation 14 and the separation chamber 102. Although minimized due to the "closed" nature of the separation due to the regulation of pressure through the check valve 364, additional force is needed to return the water constituent to the disposal layer 16 of the formation 14.

In a high water condition, the float member 216 of the input unit valve assembly 200 rises with respect to the level of the water until the closure member 214 engages the first valve seat 220 in a first "closed" position. In the first "closed" position, the production flow from the formation 14 is substantially obstructed from flowing into the separation chamber 102. At the surface, the high-water condition is observed by a reduction in pressure or flow rate of fluids through the production string 18 and the flow passage 307.

The water level in the separation chamber 102 is lowered by injecting the water into the disposal layer 16 by increasing pressure through the production string 18 and forcing oil downward through the flow passage 307 into the oil separation unit 302 and the separation chamber 102. As the pressure of the injected oil increases in the separation chamber 102 to a level greater than that of the disposal layer 16 of the petroleum formation 14, the waste water is injected through the fluid disposal unit 400 through input port 406 and output port 408 into the lower annulus 40. From the lower annulus 40, the water is injected into the disposal layer 16.

Figure 5:
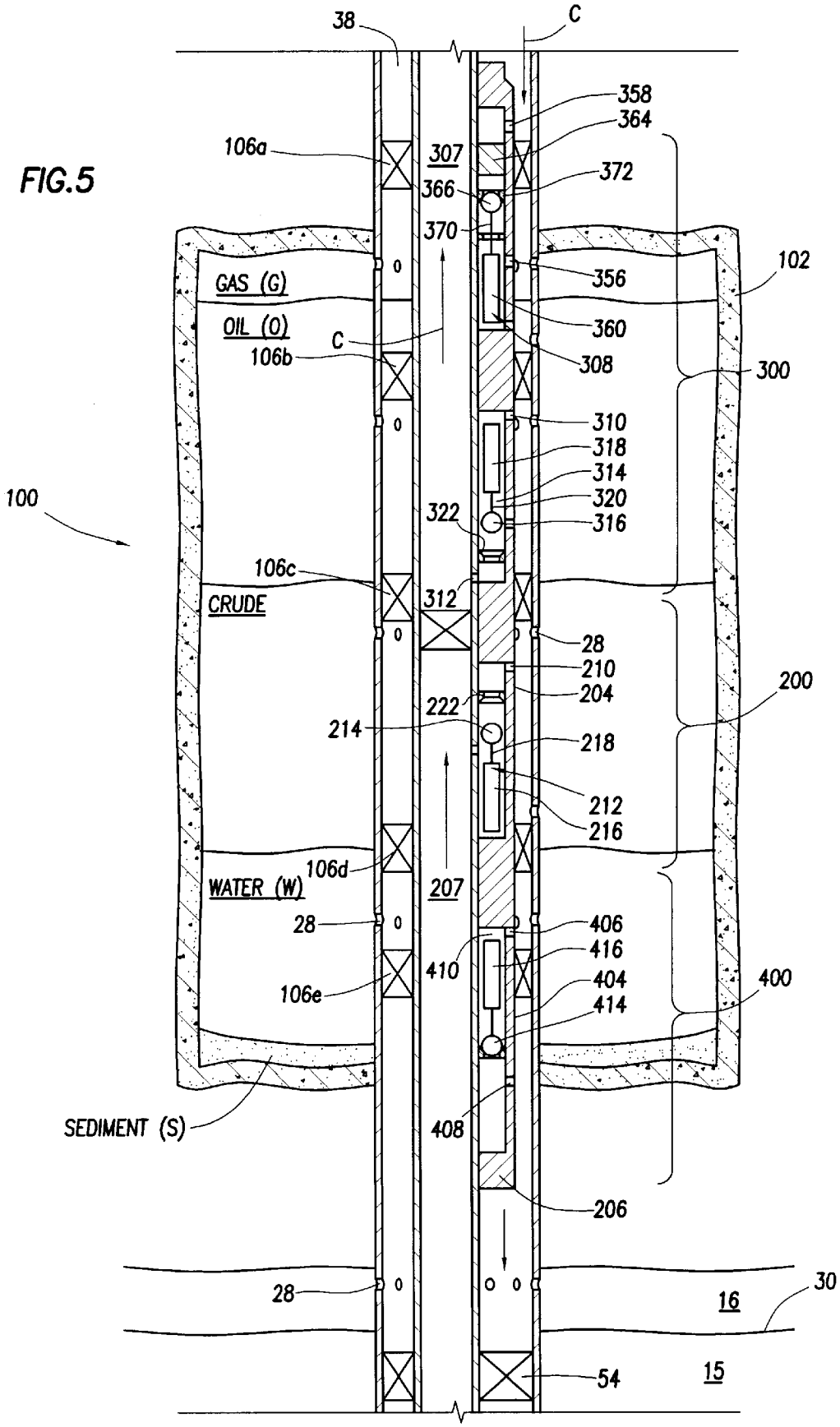
FIG. 5 is a cross-sectional view of the side-wall of the present invention in a high-oil operational mode.

FIG. 5 illustrates the operation of the side-wall separator assembly 100 in the event of high oil. A high-oil condition can occur when there is insufficient formation pressure to lift the oil constituent to the well surface through the flow passage 307. With high oil conditions, the level of the oil rises over time in the separation chamber 102 and must be removed using lifting techniques.

Generally, as a producing formation is depleted, formation pressure is correspondingly reduced. The formation pressure is determined in part by the pressure burden of the formation structure that rests on the producing formation 14.

Accordingly, the present invention provides a gas lift function to provide secondary recovery of the production fluid. The gas constituent in the upper annulus 38 can be injected into the oil layer within the separation chamber 102 to cause the oil to become lighter or less dense, thus increasing the buoyancy of the oil.

In a high oil condition, the float member 368 of the gas separation unit 350 also rises with respect to the level of the oil until the closure member 366 engages the valve seat 372 in a "closed" position. As the production flow from the formation 14 continues to flow into the chamber, a lower boundary level of the oil constituent extends downward as the amount of separated crude increases over time. The production flow continues until the float member 216 lowers with the level of the oil until the closure member 214 of the input valve assembly 200 engages the second valve seat 222, substantially obstructing the passage of production fluids from the formation 14 into the separation chamber 102. At the surface, the existence of a high oil condition is shown by the resulting a diminished production of the gas constituent.

In some formations, an artificial lift is necessary to transport oil to the surface. In general, this is necessary when the formation pressure is or becomes insufficient to push the oil to the surface. For example, crude typically weighs about six pounds per gallon (about 0.7 kilograms per liter). Thus, an advantage of the present invention is that the less dense oil constituent is separated from the crude prior to transport to the surface, decreasing the amount of lifting energy necessary to bring the oil to the surface.

But if there is insufficient pressure in the formation to naturally lift the separated oil constituent to the surface, gas injection can be used to dissolve gas in the oil, decreasing its density so that the naturally occurring formation pressure can then lift the oil product and the solution gas, which is gas dissolved in oil, to the surface.

Accordingly, the gas constituent in the upper annulus 38 can be injected with the present invention by increasing the annulus pressure. The injected gas can be the free gas separated from the crude or the injected gas can be from another source to lessen the density of the oil. As the pressure increases in the annulus, the check valve 364 meters the gas into the separation chamber 102. The injected gas infuses the fluids within the chamber 102 such that the density of the oil decreases and the formation pressure can lift the oil constituent to the well surface. In this respect, the float member 216 has a high tolerance to deviations of fluid densities within the separation chamber 102. Generally, a suitable pressure for gas lift injection is dependent on the characteristics of the crude, which can be determined through conventional sampling techniques.

Returning waste products, or non-valuable yield, to the disposal layer 16 has at least two advantages. First, energy is not expended to bring this waste component to the surface, which at that stage requires an additional cost for disposal. Second, the producing life-span of the formation is extended; otherwise, over-production by bringing all formation fluids to the surface damages the formation by compaction of the surrounding formation geology, decreasing the porousness of the formation and restricting the flow of fluids into the production string 18.

Although the invention has been described with reference to a specific embodiment, these descriptions are not meant to be construed in a limiting sense. Various modifications of the disclosed embodiments, as well as alternative embodiments of the invention will become apparent to persons skilled in the art upon reference to the description of the invention. It is therefore contemplated that the claims will cover any such modifications or embodiments that fall within the true scope and spirit of the invention.

What is claimed is:

1. A downhole separation chamber comprising:

an under-reamed cavity defined in a downhole environment about a portion of a well bore, said under-reamed cavity defined by large bore drilling for receiving a production fluid having a valuable yield and having an interior volume sufficient to quiescently separate a valuable yield from the production fluid from the well bore.

2. The downhole separation chamber of claim 1 further comprising:

a cavity seal adjacent an inner surface of said under-reamed cavity.

3. A downhole separation apparatus for a formation fluid having a plurality of constituents each having a different density characteristic, the downhole separation apparatus comprising:

a separation chamber having an input for the formation fluid, a production output, and a disposal output, said separation chamber having an associated residence time for quiescently separating at least a first and a remainder constituent of the plurality of constituents from the formation fluid;

an input flow regulator coupled to said input of said separation chamber and responsive to a level of the formation fluid in said separation chamber by flowing the formation fluid from a subterranean formation into said separation chamber;

a production regulator coupled to said production output of said separation chamber and responsive to a level of said first constituent separated from the formation fluid by flowing the first constituent from said separation chamber and toward a well surface; and a disposal regulator coupled to said disposal output of said separation chamber and responsive to a level of said remainder constituent from the formation fluid by flowing the remainder constituent from said separation chamber to a disposal layer below said separation chamber.

4. The apparatus for fluid separation in a downhole environment of claim 3 wherein said separation chamber is a well bore.

5. The apparatus for fluid separation in a downhole environment of claim 3 wherein said separation chamber is an under-reamed portion of a well bore.

6. The apparatus for fluid separation in a downhole environment of claim 3 further comprising:

a pressure regulator having an input port and an output port, said pressure regulator input port coupled to said production output, said pressure regulator for limiting a threshold pressure level of said formation fluid in said separator chamber, said pressure regulator also allowing a pressurization of said separation chamber sufficient to urge said first constituent through said production regulator.

7. The apparatus for fluid separation in a downhole environment of claim 6 wherein said pressure regulator comprises a check valve.

8. The apparatus for fluid separation in a downhole environment of claim 3 wherein said input flow regulator, said production regulator, and said disposal regulator each comprise:

a side-pocket mandrel;

a replaceable valve assembly received in said side-pocket mandrel, said valve assembly being replaceable while downhole; and an isolation packer on an outer surface of said side-pocket mandrel for isolating each of said regulators from each other.

9. The apparatus for fluid separation in a downhole environment of claim 8 wherein said valve assembly comprises:

a valve body defining a flow space between an input port and an output port;

a float valve in said flow space between said input port and said output port, said float valve having a closure member coupled to a float member; and a valve seat between said input port and said output port, said valve seat adapted to sealingly receive said closure member of said float valve such that a flow of fluids from said input port to said output port is substantially ceased.

10. The apparatus for fluid separation in a downhole environment of claim 9 wherein said valve assembly further comprises:

a spring member coupled to said float valve to bias said float valve in a disengaged position with respect to said valve seat, wherein the amount of bias is less than the pressure exerted by said float member of said float valve when displaced with respect to the level of a fluid within said separation chamber.

11. Apparatus for fluid separation in a downhole environment, the apparatus comprising:

a separation chamber defined by an under-reamed portion of a well bore whereby said under-reamed portion is defined by large bore drilling, said separation chamber for receiving and for quiescently separating a production fluid from the well bore having at least a first constituent with a first density and a second constituent with a second density sufficiently greater than said first density such that said at least first constituent and said second constituent have a tendency to separate over time in the presence of a gravitational force; and a fluid separator received through said chamber, said separator including an input unit defining a first flow passage in fluid communication with said separation chamber through an input flow regulator, said input flow regulator being responsive to a density property of said production fluid for regulating said production fluid from said flow passage into said chamber with respect to a level of said production fluid;

a fluid production unit defining a second flow passage in communication with said chamber, said production unit having a production flow regulator responsive to a density property of said first constituent of said production fluid for regulating a flow of said first constituent into said second flow passage, said second flow passage being buffered from said first flow passage; and a fluid disposal unit in communication with said chamber and having a valve responsive to a density property of said second constituent for regulating said second constituent within said disposal portion for conveying said second constituent through a third flow passage to a disposal zone within said downhole environment and below said chamber.

12. The apparatus for fluid separation in a downhole environment of claim 11 further comprising:

a pressure regulator having an input port and an output port, said pressure regulator input port coupled to said production output, said pressure regulator for limiting a threshold pressure level of said formation fluid in said separator chamber, said pressure regulator also allowing a pressurization within said separation chamber sufficient to urge said first constituent through said production regulator.

13. The apparatus for fluid separation in a downhole environment of claim 12 wherein said pressure regulator comprises a check valve.

14. The apparatus for fluid separation in a downhole environment of claim 11 wherein said input unit, said fluid production unit, and said fluid disposal unit each comprise:

a side-pocket mandrel;

a replaceable valve assembly received in said side-pocket mandrel, said valve assembly being replaceable while downhole; and an isolation packer on an outer surface of said side-pocket mandrel for isolating each of said units from each other.

15. The apparatus for fluid separation in a downhole environment of claim 14 wherein said valve assembly comprises:

a valve body defining a flow space between an input port and an output port;

a float valve in said flow space between said input port and said output port, said float valve having a closure member coupled to a float member; and a valve seat between said input port and said output port, said valve seat adapted to sealingly receive said closure member of said float valve such that a flow of fluids from said input port to said output port is substantially ceased.

16. The apparatus for fluid separation in a downhole environment of claim 15 wherein said valve assembly further comprises:

a spring member coupled to said float valve to bias said float valve in a disengaged position with respect to said valve seat, wherein the amount of bias is less than the pressure exerted by said float member of said float valve when displaced with respect to the level of a fluid within said separation chamber.

17. A method for separating a production fluid downhole, the method comprising the steps of:

flowing a production fluid from a subterranean formation into a separation chamber;

quiescently separating the production fluid into a plurality of constituent layers over a residence time period determined as a function of a volume of the separation chamber, each constituent of the plurality of constituent layers having a different density property;

lifting at least a first constituent of the plurality of constituents from the separation chamber by injecting under pressure a second constituent of the plurality of constituents into the first constituent, the second constituent being more dense than the first constituent; and disposing a remainder constituent of the plurality of constituents to a disposal layer in the subterranean formation.

18. The method for separating a production fluid downhole of claim 17, wherein the step of disposing comprises the steps of:

injecting under pressure the first constituent of the plurality of constituents into the separation chamber; and urging the remainder constituent into the disposal layer.

* * * * *